United States Patent [19]

Monsler

[11] 4,036,012

[45] July 19, 1977

[54] LASER POWERED ROCKET ENGINE USING A GASDYNAMIC WINDOW

[75] Inventor: Michael J. Monsler, Reading, Mass.

[73] Assignee: The United States of America as represented by the Secretary of the Army, Washington, D.C.

[21] Appl. No.: 659,060

[22] Filed: Feb. 18, 1976

[51] Int. Cl.[2] ..... H05H 1/24

[52] U.S. Cl. ..... 60/203; 219/121 L

[58] Field of Search ..... 60/202, 203; 126/270, 126/271; 219/121 L

[56] References Cited

U.S. PATENT DOCUMENTS

| | | | |
|---|---|---|---|
| 3,064,418 | 11/1962 | Sanders | 60/203 |
| 3,083,528 | 4/1963 | Brown | 60/203 |
| 3,392,527 | 7/1968 | Gilmour et al. | 60/202 |
| 3,825,211 | 7/1974 | Minovitch | 60/203 |
| 3,885,884 | 5/1975 | Wilkinson | 417/65 |

OTHER PUBLICATIONS

Parmentier et al., "Supersonic Flow Aerodynamic Window for High-Power Lasers", AIAA Journal, July, 1973, pp. 943-949.

*Primary Examiner*—Carlton R. Croyle
*Assistant Examiner*—Robert E. Garrett
*Attorney, Agent, or Firm*—William G. Gapcynski; Lawrence A. Neureither; Freddie M. Bush

[57] ABSTRACT

Optics capture and concentrate laser radiation and send it through a gasdynamic window which is formed by supersonic expansion of unseeded hydrogen gas exiting a passageway directly under the opening. Seeded fuel is inserted into the chamber where it is heated by the laser radiation and the energy of the heated gas is converted into kinetic energy of a high velocity by means of a rocket nozzle.

3 Claims, 5 Drawing Figures

LASER POWERED ROCKET ENGINE USING A GASDYNAMIC WINDOW

DEDICATORY CLAUSE

The invention described herein was made under a contract with the Government and may be manufactured, used, and licensed by or for the Government for governmental purposes without the payment to me of any royalties thereon.

BACKGROUND OF THE INVENTION

Many systems have been tried in the past to use laser energy to create propulsion for a rocket system. See the patents to William C. Brown, U.S. Pat. No. 3,083,528; William C. Brown, U.S. Pat. No. 3,114,517; and Michael Minovitch, U.S. Pat. No. 3,825,211; and the article entitled "Laser propulsion" by Frank E. Rom et al, published April 1972 by NASA TM X. All of these prior publications suffer from impracticality of the arrangements of the collection of the laser radiation and the transmission of it to the propulsion medium.

SUMMARY OF THE INVENTION

The invention concerns a new type of laser powered rocket engine. The laser powered rocket uses a system of optics (mirrors) to concentrate an earth-bound laser beam in the critical zone of the rocket where the beam energy is absorbed by the propellant. A rocket nozzle is provided to expand the hot gas to form a supersonic jet exhaust. Supersonic expansion of gas is used to create sufficiently large pressure differences to form a window in the rocket stagnation chamber. The "seed" which is added to the propellant to absorb the laser radiation is added after the window. The unseeded propellant, hydrogen or helium, is transparent to $CO_2$ laser radiation at 10.6 $\mu$ when the gas is not ionized. An annular ring mirror or rotatable collecting mirror is arranged external to the rocket for collecting the earth-bound laser radiation and directing it through apertures in the stagnation chamber of the rocket engine. An apparent "window" across the apertures is formed by the supersonic expansion of unseeded hydrogen gas exiting a passageway directly under the opening. Unseeded liquid hydrogen is forced through oppositely disposed tube-like passages on the outer framework of the engine, beginning at the nozzle. As the unseeded hydrogen progresses through the passage, the high temperature created by the escaping exhaust changes the phase of the hydrogen from liquid to gas. The passage ends directly below the opening in the stagnation chamber causing a rapid supersonic expansion of the pressurized gas across the aperture, thus creating the "window" effect. The laser beam can pass freely through the opening without absorption.

DESCRIPTION OF THE PREFERRED EMBODIMENT

This disclosure describes a new type of laser powered rocket engine. A laser powered rocket engine is a device which produces useful thrust for propulsion of a rocket, using the energy provided by laser radiation which is beamed up to the rocket from a laser located on the ground. The Laser Powered Rocket Engine (LPRE) is the device which converts power carried by laser radiation (electromagnetic waves or photons) into power in an exhaust jet of high velocity gas. The jet of gas provides the thrust similar to the operation of an ordinary chemical rocket engine.

The laser powered rocket engine must have three key components. These are:

a. Some form of optics to capture and/or concentrate the laser radiation.

b. Some way to absorb the laser radiation in the propellant to provide a hot gas or ionized plasma at very high temperature.

c. Some type of rocket nozzle to expand the hot gas to form a supersonic jet useful for producing thrust by the principle of action and reaction.

These same processes may be stated in different words in the following three corresponding steps.

a. Energy in the form of a flux of radiation which is at a low flux density so that it can be transmitted through the atmosphere without being absorbed, and is concentrated by the use of mirrors so that it can be better absorbed in the propellant.

b. Energy in the radiation field is converted into heat or thermal energy of the propellant gas by absorption.

c. Thermal energy of a slow moving gas is converted into kinetic energy of a high velocity jet by means of a rocket nozzle.

Figure 1:
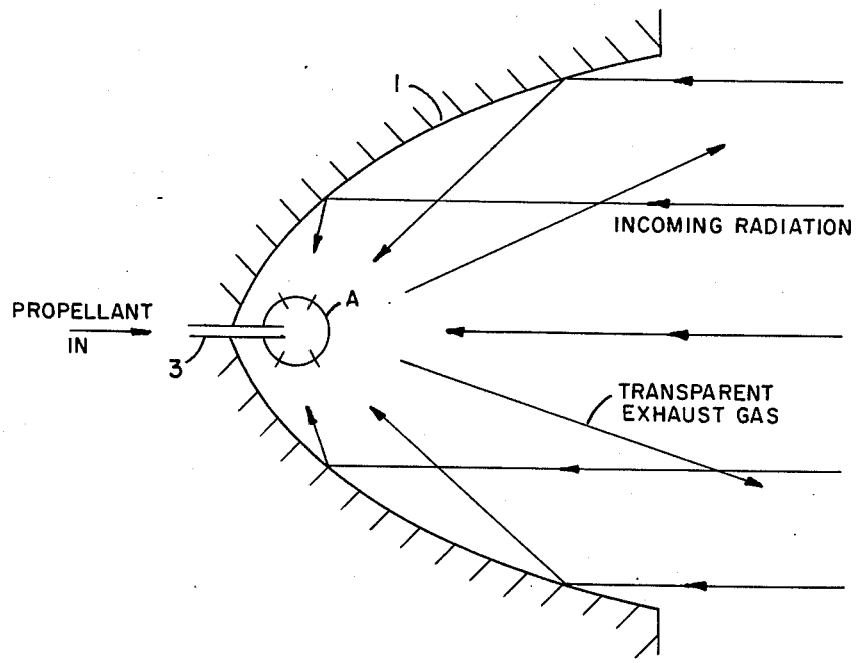
FIG. 1 is a showing of a parabolic nozzle rocket engine.

One way of making a LPRE is illustrated in FIG. 1. A combination parabolic mirror and rocket nozzle 1 is used; combining the functions of (a) and (b). The incoming radiation is reflected off the parabolic mirror to the sonic surface A. Propellant is fed in through a nozzle 3 to the sonic surface A where it is heated by the incoming radiation which is focused on the sonic surface A. The propellant expands out and provides propulsion for the rocket and produces transparent exhaust gas to the incoming radiation.

This system has the advantage of simplicity, but the great disadvantage of requiring the propagation of the laser radiation straight up the rocket exhaust. It is a very sensitive and difficult procedure to arrange the geometry of the mirror-nozzle and the chemistry of the propellant so that there is no absorption of the radiation in the supersonic exhaust gases except in a small absorption zone near the propellant infeed. No steady state propulsion at high specific impulse (over 500 sec) has been achieved. This is because experiments conducted so far resulted in failure to achieve steady state high specific impulse because absorption occurred in the exhaust and shock waves formed which were opaque to radiation and which traveled up the laser beam. These laser driven absorption waves prevented the radiation from reaching the desired absorption zone, and resulted in very nonsteady and undesirable, inadequate performance.

Clearly a method of decoupling the influx of radiation from the outflux of exhaust gases is needed to positively avoid the formation and build up of these laser driven absorption waves which interfere with the desired performance of the engine.

A second reason for searching for a way to separate the influx of radiation from the outflow of exhaust gases is that many systems applications of laser propulsion are difficult or impossible when burdened by the constraint that the exhaust vector always be aligned with the laser beam. For example, launching a satellite into earth orbit using one laser is impossible with the constraint of colinear thrust vector and laser beam and without auxiliary methods of propulsion.

A window in the rocket stagnation chamber is an obvious solution to the difficulty. Unfortunately the solid windows which are currently used to pass high power fluxes of laser radiation ($>10^6$ watts/cm$^2$), such as crystals of salt or carbon, are either too small, too weak mechanically, or too absorbant to consider for a LPRE of useful size. A useful size LPRE would be physically a meter in characteristic dimension and operate at a laser power level of $10^9$ watts, as a rough example.

Figure 2:
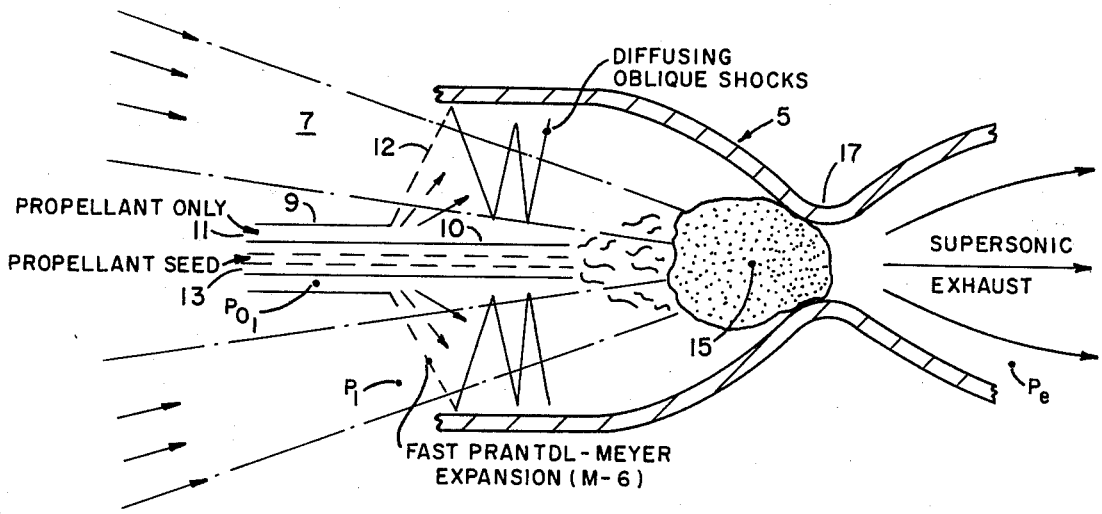
FIG. 2 is a showing of a laser powered rocket engine utilizing the principles of the present invention.

A window must not only transmit laser radiation at high flux level, it must be strong enough to withstand pressure differential across it equal to the chamber pressure of the rocket engine, approximately 50–100 atmospheres. A supersonic expansion of a gas can create these large pressure differences. All that is required is to use a supersonic expansion as a laser window as well as the propellant inlet. The "seed" which is added to the propellant to absorb the laser radiation is added after the window. The unseeded propellant, most likely hydrogen or helium, is transparent to $CO_2$ radiation at 10.6 $\mu$, when the gas is not ionized. A LPRE using such a gasdynamic expansion is shown in FIG. 2. This is a cylindrically symmetric rocket engine 5 which is powered by an annular high power laser beam 7. The propellant inflow is on the central axis and comes in via a spider-like support which is not shown. The concentric annular propellant pipes 9 and 10 carry unseeded propellant in the outer pipe 9 and seeded propellant in the inner pipe 10. The propellant 11 is a very high pressure $P_{01}$ which causes the gas to expand rapidly in a supersonic (Prandtl-Meyer) expansion, causing the pressure to drop by a very large factor to equal the ambient pressure $P_1$ and forming the annular gasdynamic window 12. The gas is then diffused down to a subsonic flow via shock waves, raising the static pressure. Seeded propellant 13 is added and the laser radiation is absorbed in the absorption zone 15. The gas is then very hot and at high pressure. The rocket nozzle 17 again creates a high velocity low pressure supersonic flow, the exit pressure of which $P_e$ is tailored to equal the ambient pressure.

Figure 3:
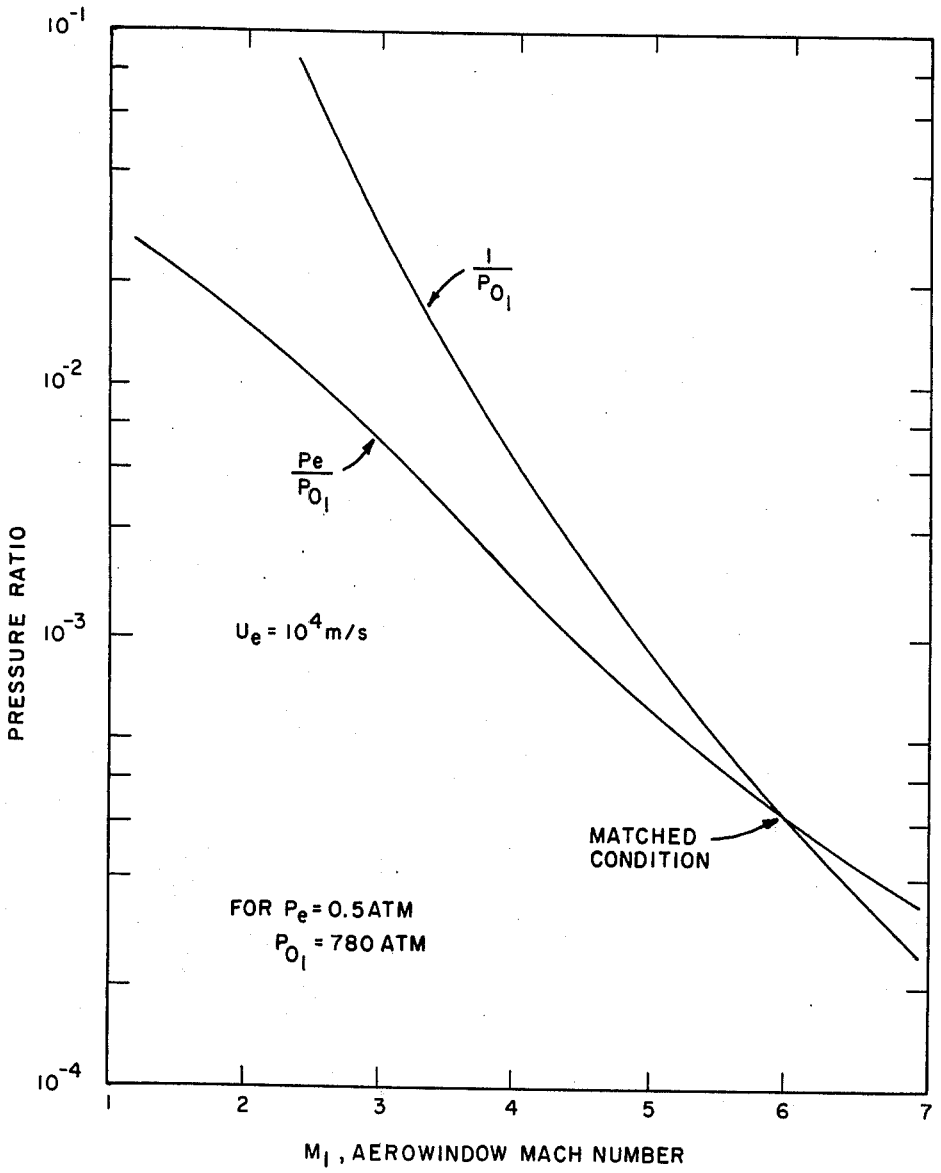
FIG. 3 is a graph of the pressure ratio versus the Aerowindow Mach number.

For a given rocket nozzle shape and desired specific impulse, there is one ideal condition at which the gasdynamic window can operate. The gas has to have a particular definite Mach number $M_1$ or pressure ratio $(P_1/P_{01})$ so as to have the inlet static pressure $P_1$ and exit static pressure $P_e$ exactly equal. The results of a typical calculation, omitting the details, is given in FIG. 3. The calculation was for a specific impulse of $10^3$ seconds, equivalent to an exit velocity of $10^4$ meters/sec. A gas of a ratio of specific heats of $\gamma = 1.4$ was taken for convenience. An exit Mach number for the rocket nozzle of $M_e = 3.0$ was taken. For these conditions the pressure ratio of the window expansion $(P_1/P_{01})$ and the nozzle exit pressure ratioed to the supply stagnation pressure $(P_e/P_{01})$ which is dependent on the window expansion are graphed against the window Mach number. Only for one condition are the pressures equal and will the rocket engine operate ideally (Mach 6 in the example).

Figure 4:
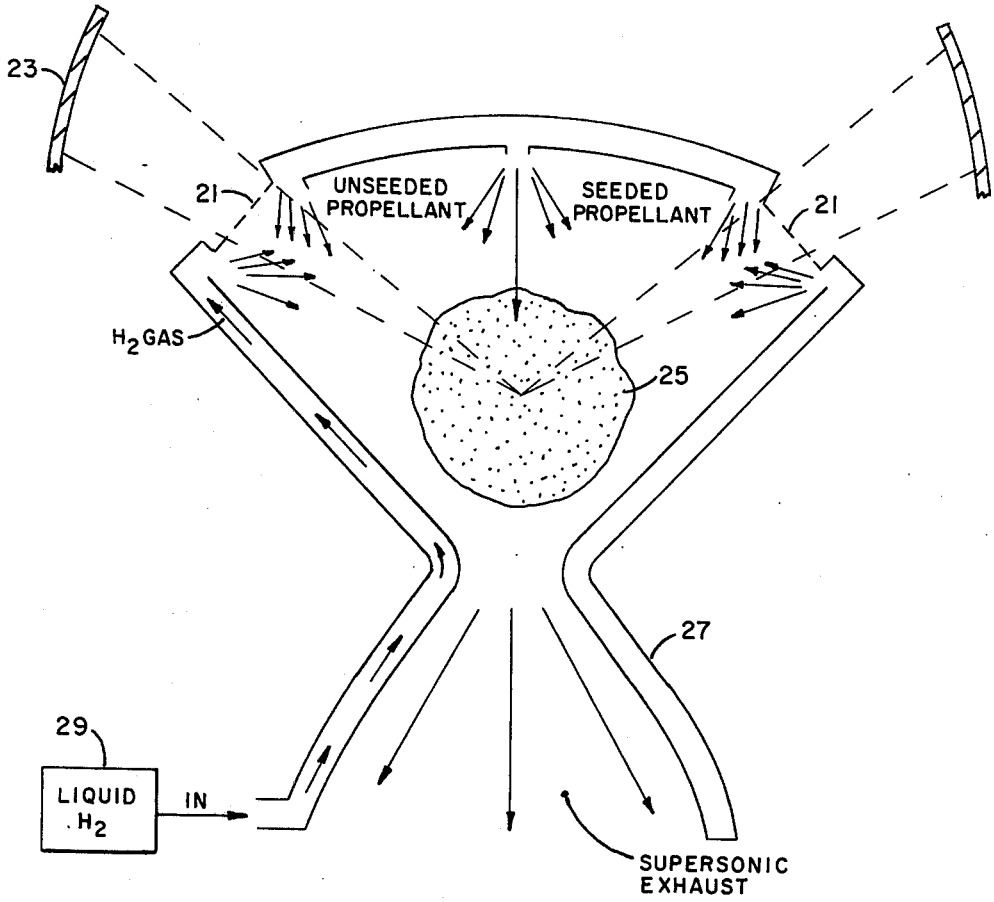
FIG. 4 is a showing of a laser powered rocket engine in accordance with the present invention.

A detailed version of the LPRE is shown in FIG. 4. The gasdynamic window 21 is around the upper perimeter of the chamber. The seedant is added in the center, away from the annular window 21. An annular ring mirror 23 is provided for reflecting the laser beam from the ground source, not shown, through the gasdynamic window 21 to the absorption zone 25 where the seeded propellant absorbs the laser radiation and becomes a very hot gas which is fed through the rocket nozzle 27 to create a supersonic exhaust to propell the missile. The rocket nozzle is hollow and is fed liquid hydrogen from a source 29. As this hydrogen passes through the passageways in the nozzle it provides cooling of the throat and at the same time changes from liquid to gas which is combined with the propellant to provide an explosive or rapidly expanding mixer. The "seed" can be any of the well known "seeds" such as deuterium.

Figure 5:
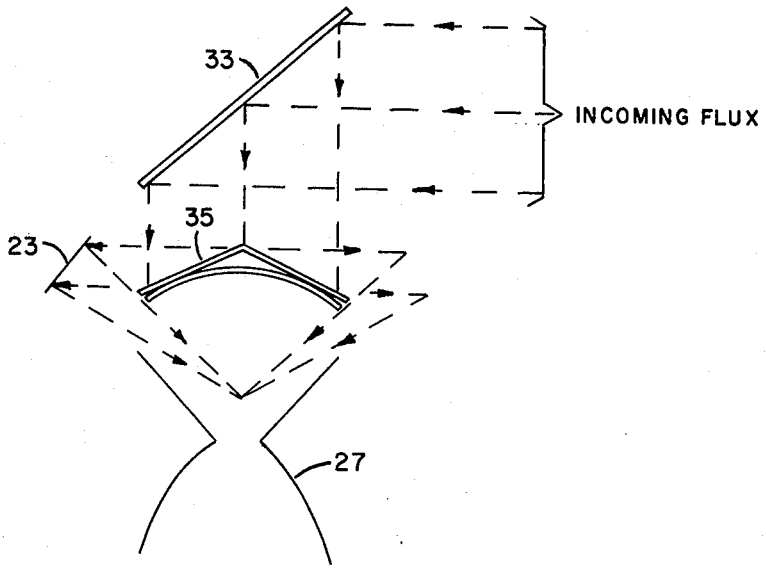
FIG. 5 is a showing of a configuration of optics for a laser powered rocket engine.

FIG. 5 shows a means for collecting the laser radiation from the ground source and feeding it to the annular ring mirror 23. It consists of a rotatable collecting mirror 33 which is aligned with the incoming laser radiation by conventional means not shown. The laser radiation is reflected from the rotatable collecting mirror 33 onto dispersing mirror 35 which is an annular cone shape mirror attached to the rocket nozzle 27. The laser radiation is reflected from mirror 35 onto the annular ring mirror 23 and through the gasdynamic window.

I claim:

1. A power system for a vehicle comprising: a nozzle having a heating chamber and an exhaust outlet; a propellant; first means for providing said propellant to said heating chamber; a gasdynamic window in said heating chamber; said gasdynamic window formed by second means which exhausts propellant at supersonic speed across said window; laser radiation being directed through said gasdynamic window to said propellant for heating said propellant; said propellant having an unseeded portion which is transparent to the laser radiation and a seeded portion which is opaque to said laser radiation; said second means directing the propellant's unseeded portion across said window; an absorption zone inside said heating chamber remote from said window; and third means for directing said seeded portion of the propellant to said absorption zone without interferring with the laser radiation until reaching the absorption zone.

2. A system as set forth in claim 1 wherein said vehicle is a rocket; said nozzle being a rocket nozzle attached to said rocket; a annuar ring mirror attached to said rocket so as to direct the laser radiation through said window to the absorption zone in a concentrated fashion; and other mirror means connected to said rocket so as to direct said laser radiation to said annular ring mirror.

3. A system as set forth in claim 2 wherein said rocket nozzle is hollow; liquid hydrogen being fed through said hollow rocket nozzle so as to absorb the heat therein and convert the liquid hydrogen to a gas; fourth means feeding the gas across said window to combine with said propellant; said window being annular in shape; and said second means sending said unseeded portion of the propellant across the window being annular in shape.

* * * * *